United States Patent [19]

Ivin et al.

[11] 4,036,429

[45] July 19, 1977

[54] BOWL OF CENTRIFUGAL SEPARATOR

[76] Inventors: Jury Filoretovich Ivin, ulitsa Kosareva, 15, kv. 62; Arkady Nikolaevich Levischev, ulitsa Griboedova, 30, kv. 21, both of Sverdlovsk; Vasily Ivanovich Sokolov, Kutuzovsky prospekt, 2, kv. 181, Moscow, all of U.S.S.R.

[21] Appl. No.: 559,409

[22] Filed: Mar. 18, 1975

[51] Int. Cl.[2] ..... B04B 1/08

[52] U.S. Cl. ..... 233/27

[58] Field of Search ..... 233/27, 28, 29, 35, 233/39, 41, 1 R, 20 R

[56] References Cited

U.S. PATENT DOCUMENTS

| | | | |
|---|---|---|---|
| 902,913 | 11/1908 | Risberg | 233/41 |
| 2,012,589 | 8/1935 | Miller | 233/29 |
| 2,028,955 | 1/1936 | Shenstone | 233/29 |
| 2,752,090 | 6/1956 | Kyselka et al. | 233/29 |
| 3,335,946 | 8/1967 | Putterlik | 233/41 |

FOREIGN PATENT DOCUMENTS

| | | | |
|---|---|---|---|
| 154,351 | 9/1904 | Germany | 233/29 |

*Primary Examiner*—George H. Krizmanich
*Attorney, Agent, or Firm*—Steinberg & Blake

[57] ABSTRACT

A bowl of a centrifugal separator for the separation of suspensions and emulsions comprising a body with a pack of cone-shaped discs inside. The cone-shaped discs are provided with spacer lugs which support the adjacent cone-shaped discs and ensure a gap between the adjacent cone-shaped discs. The cone-shaped discs carry strips located in said gaps and directed basically from the center of the discs to their periphery. The bowl is also provided with a means for the delivery of the separated liquid to the pack of the cone-shaped discs and means for unloading the sediment and discharging the centrifugal product.

8 Claims, 10 Drawing Figures

BOWL OF CENTRIFUGAL SEPARATOR

The present invention relates to the equipment for the separation of suspensions and emulsions, primarily to centrifugal separators, and more specifically it relates to their bowls.

The bowl according to the invention can be utilized in the separators employed in the chemical and food industries, in metallurgy, in medicine and other fields.

Known in the previous art is a bowl of the centrifugal separator for the separation of emulsions and suspensions comprising a body with a pack of cone-shaped discs inside, said discs carrying strips which are directed basically from the center of the discs to their periphery and which separate the adjacent cone-shaped discs. The bowl is provided with means for the delivery of the liquid being separated to the pack of cone-shaped discs, for the discharge of the centrifugal product and unloading the sediment from the body. The strips secured to the cone-shaped discs are identical in length in the entire disc pack, the number of strips on all the discs of the pack being also the same.

The liquid to be separated, i.e. suspension or emulsion flows through the delivery means into a chamber formed by the walls of the body and the pack of the cone-shaped discs and thence into said pack. As the liquid flows through the space between the cone-shaped discs from the largest to the smallest diameter of said discs, the particles contained in the liquid settle on the cone-shaped disc. The settling particles form a layer of sediment on one side of the disc, said sediment sliding down continuously into the chamber between the body and the pack of cone-shaped discs and settling on the wall of the body. This sediment is unloaded either intermittently or continuously through the sediment-unloading means. The centrifugal product flows from the pack of cone-shaped discs into the discharge means.

The above-described bowls have three basic disadvantages which affect materially the standard of separation and the output of separators; these disadvantages are the counterflow of the liquid and sediment in the inter-disc space where the process of separation occurs, entrainment of the already settled particles into the centrifugal product owing to a large velocity gradient in the liquid layers at the surface of the sediment in the inter-disc space, and nonuniform loading of the inter-disc spaces along the length of the disc pack.

Known in the art are bowls of centrifugal separators where the above disadvantages are partly countered.

For example, there is a bowl in which each inter-disc space accommodates an additional perforated disc. The inter-disc space of such a bowl is divided into an upper space and a lower space. The flow of liquid through the upper space is reduced by fastening a special flow-restricting ring to the smallest diameter of the cone-shaped disc. The liquid being separated enters the pack of cone-shaped discs from the side of the largest diameter of the discs. Solid particles contained in the liquid settle in the lower inter-disc space on the perforated disc and are taken away through its perforations into the upper inter-disc space where the movement of the liquid is relatively slow. As a result, the particles settling in the upper inter-disc space on the wall of the cone-shaped disc form a layer of sediment which moves against an insignificant counterflow of the liquid towards the larger diameter of the cone-shaped discs. This bowl is devoid of the two of the above-mentioned disadvantages while the third disadvantage persists. Besides, the introduction of an additional perforated disc between each pair of cone-shaped discs makes the bowl more bulky.

Some of the known rotors are characterized by the elimination of the third disadvantage alone, i.e. nonuniformity of loading of the inter-disc spaces along the disc pack height.

For example, there is a bowl, wherein the flow of liquid through the inter-disc space is throttled down by securing a circular partition along the periphery of the cone-shaped discs at the outlet of the centrifugal product from the pack, said partition forming an annular gap together with the adjacent cone-shaped disc. Throttling of the liquid increases the total pressure differential of the liquid moving through the inter-disc spaces to such an extent that the difference in the pressure differentials of the inter-disc spaces farthest from, and nearest to, the means for the delivery of the separated liquid is relatively small. This equalizes the loading of the inter-disc spaces along the length of the disc pack. However, the throughput of such a bowl is somewhat reduced. Besides, it is difficult to make the annular gap of a uniform width (not over $0.2.10^{-3}$m) between the circular partition and the cone-shaped disc. In addition, this bowl retains the first two of the above-mentioned disadvantages, i.e. counterflow of the liquid and sediment in the inter-disc space and entrainment of the already settled particles into the centrifugal product owing to a large gradient of velocities in the liquid layers at the surface of the sediment.

Known in the art is a bowl wherein the nonuniformity of loading of the inter-disc spaces in partly eliminated by discharging the centrifugal product from both ends of the bowl; this is achieved by dividing the bowl into two sections with a common body and a means for the delivery of the separated liquid. However, this bowl still retains the first two of the above-mentioned disadvantages.

Also known in the art is a bowl wherein the loading of the inter-disc spaces is equalized by means of special regulating devices located outside the pack of the cone-shaped discs; however, the bowl of this design is extremely difficult to manufacture.

An object of the present invention is to provide a bowl of a centrifugal separator for the separation of emulsions and suspensions wherein the counterflow of the centrifugal product and sediment in the inter-disc space would be reduced.

Another object of the invention is to provide a bowl of a centrifugal separator wherein the velocity gradient in the layers of liquid at the surface of the sediment in the inter-disc space is also reduced.

Still another object of the invention is to provide a bowl of a centrifugal separator wherein the inter-disc spaces would be uniformly loaded with the liquid to be separated throughout the length of the disc pack.

These objects are achieved by providing a bowl of a centrifugal separator for the separation of suspensions and emulsions which comprises a body accommodating a pack of cone-shaped discs, said discs being provided with strips directed basically from the center of the cone-shape discs to their periphery and located in the gaps between the adjacent cone-shaped discs, also a means for the delivery of the liquid being separated to the pack of cone-shaped discs and means for unloading the sediment and discharging the centrifugal product wherein, according to the invention, each cone-shaped disc has at least two spacer lugs which support the adjacent cone-shaped disc and whose height is so selected that the gap between the discs ensured by the lugs is larger than the thickness of the strips.

It is practicable that the spacer lugs should be located on the strips.

It is good practice to make the strips on one disc of a length different from the length of the strips on another disc with those discs which are farther from the means for the delivery of the liquid being separated carrying the longer strips.

Likewise, it is good practice that the number of strips on the cone-shaped discs would be different, this number being greater as the cone-shaped discs become farther from the means for the delivery of the liquid to be separated.

This bowl of a centrifugal separator is characterized by a lower counterflow of the liquid and sediment in the inter-disc space, a lower gradient of velocities in the layers of liquid at the surface of the sediment in the inter-disc space, and a uniform loading of the inter-disc spaces with the liquid being separated throughout the length of the disc pack which allows the output of the separator with the bowl according to the invention to be increased 2–5 times as compared with the previously known separators without changing the overall dimensions of the body and disc pack and ensuring the same quality of separation, while retaining the same output of the separator with the bowl according to the invention will improve the quality of separation several times as compared with the separators equipped with the previously known bowls. Increased concentration of particles in the separated suspension or emulsion delivered into the bowl exerts but a slight influence on the standard of separation in the bowl according to the invention which improves the reliability of separators in industrial conditions where variations in the concentration of particles in the delivered liquid may reach considerable values. Another advantage of the bowl according to the invention lies in that its design allows the known bowls of various separators to be modified to comply with the present invention at small costs.

Still another advantage of the bowl according to the invention lies in the possibility of increasing the separator output more than 2–5 times by increasing the number of cone-shaped discs in a pack which is impracticable in the known bowls owing to nonuniform loading of the inter-disc spaces throughout the length of the disc pack.

Now the invention will be described in detail by way of example with reference to the accompanying drawings, in which:

FIG. 1 is a longitudinal section of a bowl of a centrifugal separator, according to the invention;

FIG. 2 is an enlarged longitudinal section of two adjacent cone-shaped discs according to the invention, FIG. 2 illustrating the principle of operation of the invention in a diagrammatic manner while showing the components of the structure of the invention at a scale which is considerably enlarged as compared to the remaining Figs., with the relationship between the components, however, being the same in FIG. 2 as in the other Figs.;

Figure 1:
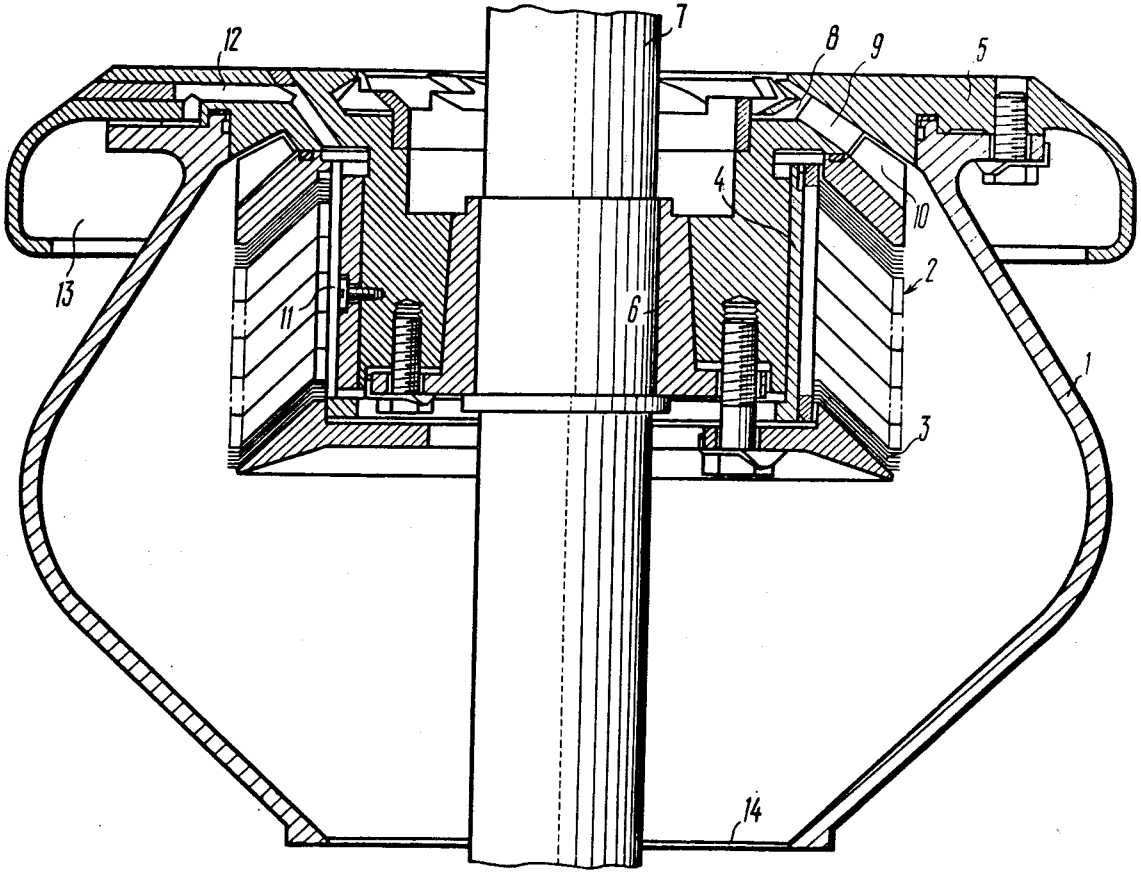

The bowl of a centrifugal separator comprises a body 1 (FIG. 1) accommodating a pack 2 of cone-shaped discs 3 (FIGS. 1, 2) secured on a disc holder 4 (FIG. 1). The disc holder 4 is fastened on a rotor cover 5 which is mounted on a bushing 6, the latter being slipped on a separator shaft 7. The means for the delivery of the liquid to be separated to the pack 2 of the cone-shaped discs 3 comprises an annular chamber 8 in the cover 5, said chamber being provided with outlet channels 9 which communicate with channels formed by ribs 10 on the disc holder 4. The liquid separated from the sediment is discharged from the pack 2 of the cone-shaped discs 3 by a means comprising channels 11 located in the disc holder 4 and communicating with channels 12 in the cover 5, and receiving annular chamber 13 communicating with the channels 12; the liquid is taken from said receiving chamber by a drawout pipe (not shown in the drawing).

In other versions of the bowl the channels for the delivery of the liquid being separated and for the discharge of the centrifugal product may be formed in separate parts located at the opposite ends of the disc pack (not shown in the drawing).

The means for unloading the sediment from the body 1 is constituted by a hole 14 in the power part of the body 1. In other designs of the bowl according to the invention the sediment can be unloaded by other means such as nozzles, auger screws, opening slits, etc., providing for intermittent or continuous unloading.

The cone-shaped discs 3 carry strips 15 (FIGS. 2, 3) directed radially and located in the gaps between the adjacent cone-shaped discs 3. The strips can also be arranged at a certain angle to the generatrix of the cone-shaped disc (not shown in the drawing) but they should remain directed basically from the center of the cone-shaped disc to its periphery.

Figure 3:
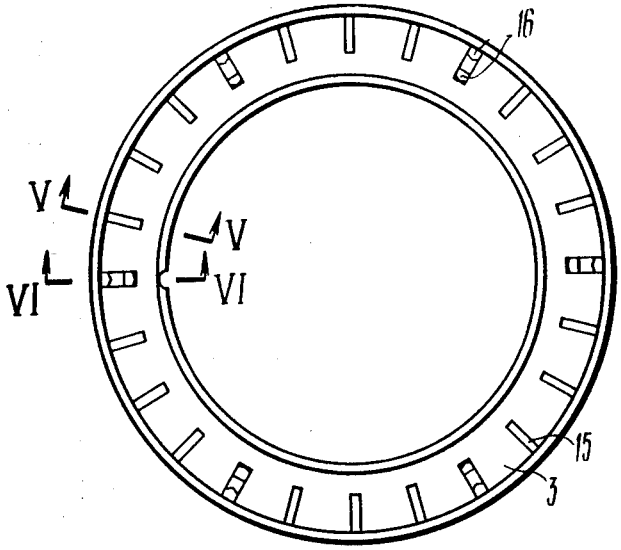
FIG. 3 is a plan view of the cone-shaped disc of the bowl according to the invention, nearest to the means for the delivery of the liquid being separated.
Figure 4:
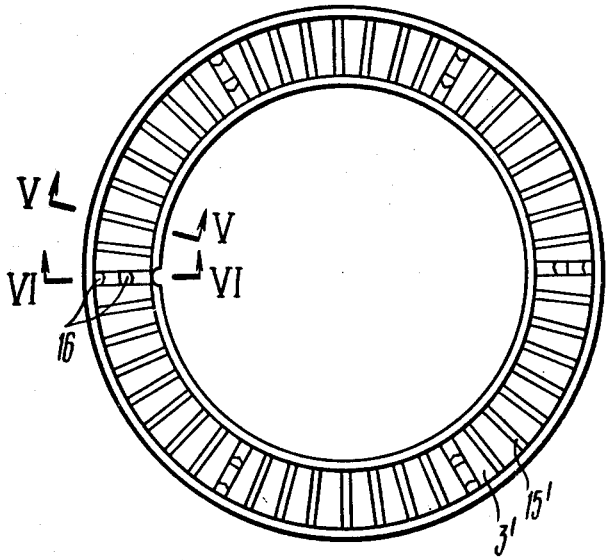
FIG. 4 is a plan view of the cone-shaped disc of the bowl according to the invention, farthest from the means for the delivery of the liquid being separated.

The strips are of the same length on any one disc but of different lengths on different discs, respectively, with this strip length being greater as the discs become farther from the means for the delivery of the liquid to be separated. Thus, the strips 15 on the cone-shaped disc 3 illustrated in FIG. 3 and contained in the pack 2 (FIG. 1) said disc being the first in the direction from the channels formed by ribs 10, are shorter than the strips 15' (FIG. 4) on the cone-shaped disc 3' located in the pack at a longer distance from the channels formed by ribs 10.

The number of strips 15 (FIG. 3) on the cone-shaped disc 3 is smaller than that of the strips 15' (FIG. 4) on the cone-shaped disc 3'. However, the bowls according to the invention can be made with cone-shaped discs whose strips are of different lengths as stated above while the number of strips is the same on all the discs of the pack. Varying the length and number of the strips it is possible to control the loading of the inter-disc spaces throughout the length of the pack 2 (FIG. 1) of the cone-shaped discs 3, thus equalizing the hydraulic resistances to the flow of the liquid from the channels formed by the ribs 10 into the channels 11 through any inter-disc space in the disc pack 2.

Figure 2:
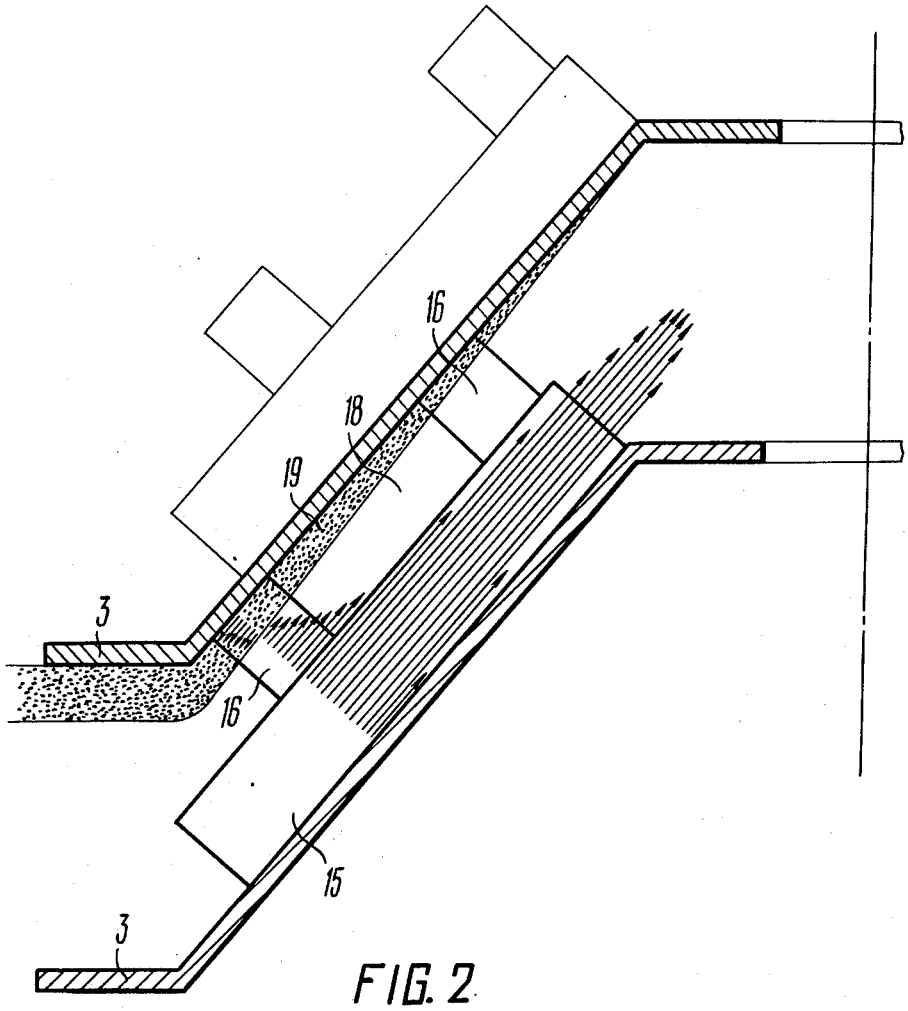
Figure 5:
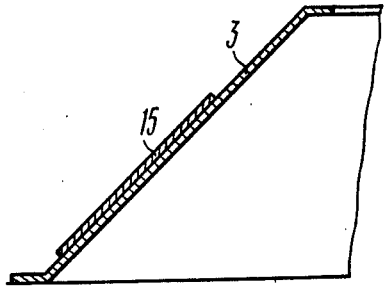
FIG. 5 is a section taken along line V—V in FIG. 3.
Figure 6:
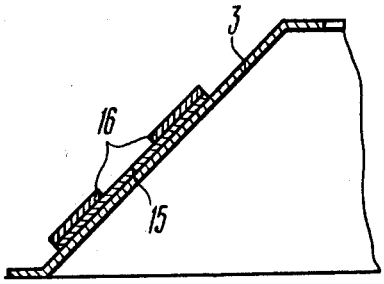
FIG. 6 is a section taken along line VI—VI in FIG. 3.
Figure 7:
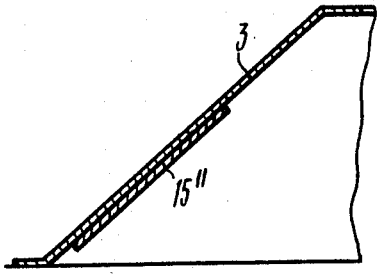
FIG. 7 shows in a fragmentary sectional view another manner of mounting the strip on the cone-shaped disc the section of FIG. 7 being taken in a plane which includes a strip which does not carry spacer lugs.
Figure 8:
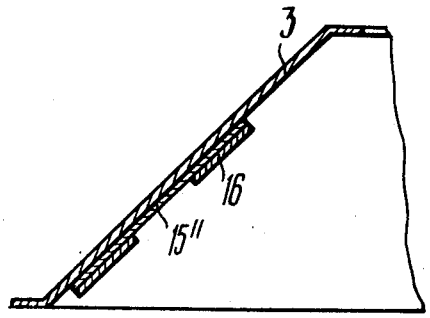
FIG. 8 shows the same embodiment as FIG. 7 but taken in a plane different from that of FIG. 7 and illustrating the manner of mounting the strip with a spacer lug on the cone-shaped disc, according to the invention.

The strips can be secured either to the external or internal side of the cone-shaped discs, depending on the density of the particles which are separated from the liquid in the pack 2. If the density of the particles is higher than that of the liquid, the strips should be secured as it is shown for the strips 15 in FIGS. 5, 6; if the density of the particles is lower than that of the liquid, the strips are secured to the inner side of the cone-shaped disc, like strips 15" (FIGS. 7, 8). The cone-shaped discs 3 have spacer lugs 16 (FIGS. 2, 3) supporting the adjacent cone-shaped disc 3. The number of lugs 16 is the same on all the cone-shaped discs 3 and is not less than two on each disc 3; at assembly, all the lugs 16 are arranged accurately one above the other. The lugs 16 ensure a gap between the adjacent cone-shaped discs 3, said gap being larger than the thickness of the strips 15 as can be seen in FIG. 2.

Figure 9:
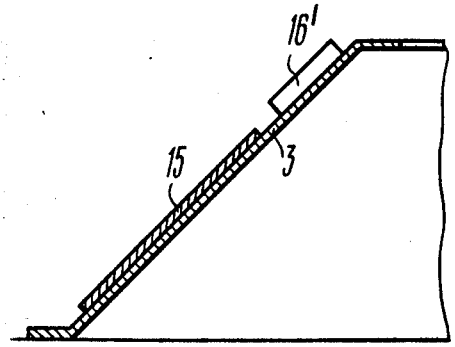
FIG. 9 illustrates another manner of mounting the spacer lug on the cone-shaped disc according to the invention.

The spacer lugs 16 are secured on the strips 15 of the cone-shaped discs 3. However, they can be secured directly to the cone-shaped discs 3, thus forming a spacer means for providing between adjacent discs 3 a gap of a thickness greater than the thickness of the strips such as the lugs 16' (FIG. 9), though such an arrangement causes turbulent zones when the liquid flows around the lugs. Being secured to the strips, the lugs are located in a zone where the fluid flows at a low velocity (see description below) which causes no turbulence.

In the case of a cone-shaped disc 3 provided with strips 15" (FIG. 8) arranged on the inner side of the disc it is practicable that the spacer lug 16 should also be arranged on the inner side of said cone-shaper disc 3.

Figure 10:
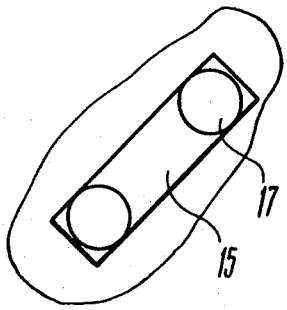
FIG. 10 illustrates another manner of the spacer lug, in a plan view, according to the invention.

The shape of the lugs may differ in plan view. For example, the lug 16 (FIG. 4) is polygonal and the lug 17 (FIG. 10) circular.

The bowl of a centrifugal separator according to the invention operates as follows.

As the bowl revolves, the liquid being separated is delivered into the chamber between the pack 2 (FIG. 1) of the cone-shaped disc 3 and the body 1 through the channels 9 and the channels formed by the ribs 10 and thence into the inter-disc spaces of the disc pack 2. As the liquid flows radially from the largest diameter of the cone-shaped discs 3 to their smallest diameter it is subjected to Coriolis acceleration in the inter-disc space. The hydraulic resistance to the liquid flow in the annular space 18 (FIG. 2) limited by the inner surface of the cone-shaped disc 3 and the upper surface of the strips 15 is several times greater than it is in the space between the strips 15 because the liquid moves ahead of the rotation of the cone-shaped discs 3 in the space 18; therefore, the liquid flow between these two spaces is distributed in such a way that the major proportion of liquid (80–90%) flows through the space between the strips 15 while the space 18 forms a stagnant zone with a sluggish movement of the liquid.

Such a stagnant zone in the place 18 reduces considerably the counterflow of the liquid and sediment and the velocity gradient near the surface of the layer of sediment moving over the inne wall of the cone-shaped disc 3. These advantages become conspicuous if we analyze the diagram of liquid velocity in the inter-disc space shown in FIG. 2 by arrows which indicate the velocities of the sediment and centrifugal product.

The space between the strips 15 serves for the separation of particles from the liquid while in the space 18 the layer 19 of sediment slides over the cone-shaped disc 3 into the chamber between the body 1 (FIG. 1) and the pack 2 of the cone-shaped discs 3. In this chamber the sediment settles on the wall of the body and is taken out periodically through the hole 14 after stopping the bowl. The centrifugal product is discharged from the pack 2 of the cone-shaped discs 3 through channels 11 and 12 into the chamber 13 from which it is taken out by the drawout pipe.

What we claim is:

1. In a centrifugal separator, a pack of cone-shaped discs and means carrying said pack with the discs thereof arranged along a common axis passing through the centers of said discs, spacer means being situated between each pair of adjacent discs for providing therebetween a gap of predetermined thickness, each disc having an inner suface directed toward and an outer surface directed away from said axis, and each disc fixedly carrying on one of its surfaces a plurality of elongated strips circumferentially distributed about said axis and extending substantially radially with respect thereto so that the strips fixed to said one surface of each disc define radial spaces between themselves, and said strips having a thickness less than the thickness of said gap so that while liquid is compelled to flow radially in said spaces between said strips the liquid is free to flow circumferentially in the part of each gap situated beyond the strips situated therein, the major portion of the liquid which is to be separated passing radially through the spaces between said strips while the part of each gap situated beyond said strips defines a stagnant zone of annular configuration in which there is a substantially negligible movement of the liquid being separated so that solid particles can accumulate in the stagnant zone, and liquid-delivery means situated adjacent one end of said pack for delivering liquid to be separated thereto.

2. The combination of claim 1 and wherein said strips are carried by said discs at said outer surfaces thereof, so that the stagnent zone is defined between an inner surface of each disc and the strips carried by the outer surface of the next disc.

3. The combination of claim 1 and wherein said strips are carried by an inner surface of each disc so that the stagnant zone is defined between the outer surface of each disc and the strips carried by the inner surface of the next disc.

4. The combination of claim 1 and wherein said spacer means includes lugs spaced from said strips and extending between and engaging adjacent discs.

5. The combination of claim 1 and wherein said spacer means includes lugs carried by some of said strips on each disc and extending between the latter strips and the next disc.

6. The combination of claim 1 and wherein the strips carried by any one of said discs are all of the same length while the strips on the several discs are respectively of different lengths, the latter lengths being greater as each disc is more distant from said liquid-delivery means.

7. The combination of claim 6 and wherein the number of strips on any one disc is different from the number on any other disc with said number being greater as the distance of each disc from said liquid-delivery means is greater.

8. The combination of claim 1 and wherein the number of strips on any one disc is different from the number of strips on another disc with said number being greater as the distance of each disc from said liquid-delivery means is greater.

* * * * *